United States Patent [19]

Rose et al.

[11] 4,091,651

[45] May 30, 1978

[54] DRAWING, STRAIGHTENING, SECTIONING AND POLISHING MACHINE

[75] Inventors: Léon Rose; Christian Mandras, both of Revigny-sur-Ornain, France

[73] Assignee: Societe Metallurgique de Revigny, Revigny-sur-Ornain, France

[21] Appl. No.: 712,574

[22] Filed: Aug. 9, 1976

[30] Foreign Application Priority Data

Aug. 8, 1975 France ..... 75 24795

[51] Int. Cl.[2] ..... B21C 1/12

[52] U.S. Cl. ..... 72/289; 72/40; 72/275; 72/279

[58] Field of Search ..... 72/278, 280, 286, 287, 72/288, 289, 40, 275

[56] References Cited

U.S. PATENT DOCUMENTS

| | | | |
|---|---|---|---|
| 424,839 | 4/1890 | White | 72/289 |
| 1,751,094 | 3/1930 | Matteson | 72/40 |
| 1,984,756 | 12/1934 | Offutt | 72/287 |
| 2,067,973 | 1/1937 | McIlvried | 72/289 |
| 2,481,944 | 9/1949 | Nye | 72/289 |
| 2,630,910 | 3/1953 | Turner | 72/287 |
| 3,143,786 | 8/1964 | Jones et al. | 72/278 |
| 3,413,834 | 12/1968 | Kovaleski | 72/289 |
| 3,470,723 | 10/1969 | Remner | 72/289 |
| 3,841,126 | 10/1974 | Minami et al. | 72/45 |
| 3,842,643 | 10/1974 | Large et al. | 72/286 |

*Primary Examiner*—Michael J. Keenan

*Attorney, Agent, or Firm*—Sughrue, Rothwell, Mion, Zinn and Macpeak

[57] ABSTRACT

A pulling device for drawing the product through the draw die comprises a drum around which the drawn product is wound as it issues from the die. The drum is driven in rotation and a device for putting the drawn product leaving the drum under tension causes the drum to operate in the manner of a capstan.

7 Claims, 9 Drawing Figures

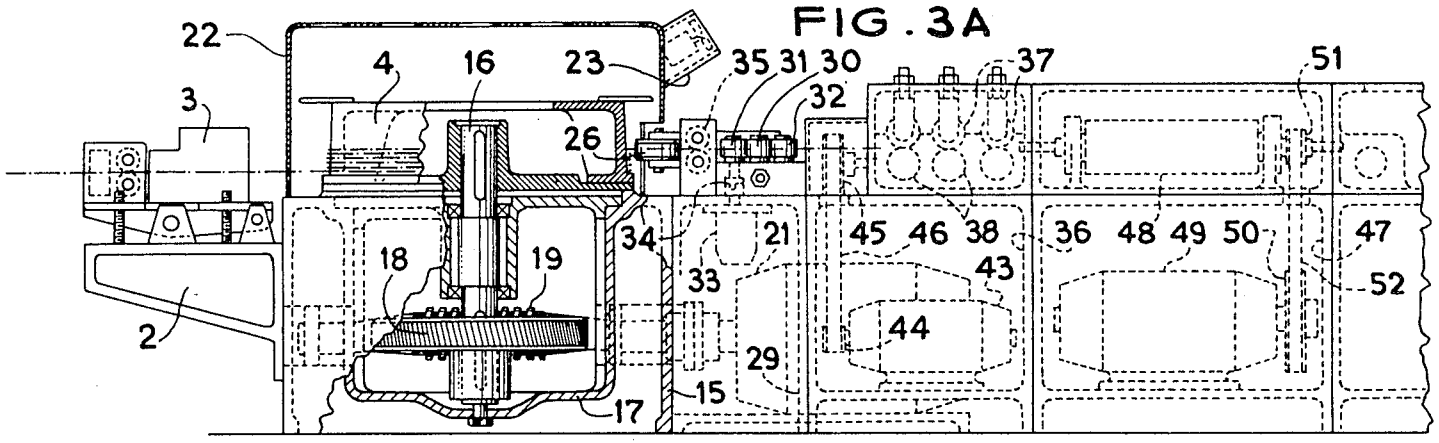
FIG. 3A
51
47
52
50
49
48
36
37
38
43
46
44
45
30
32
31
35
21
29
33
15
34
17
23
26
19
16
4
18
22
3
2
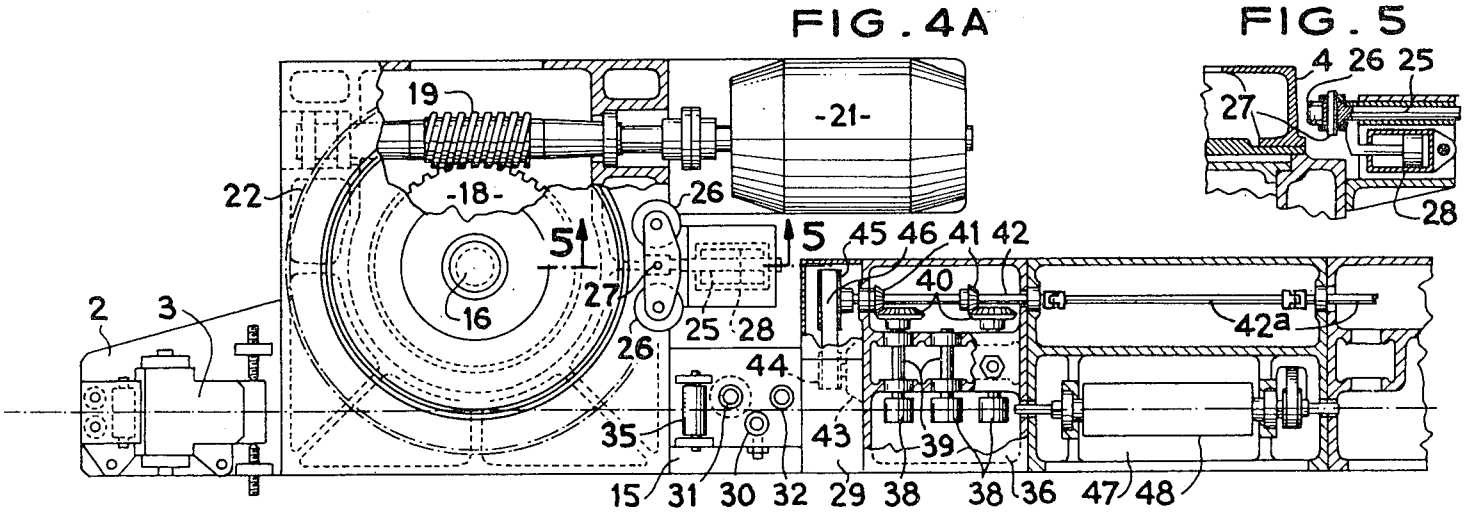
FIG. 5
4
26
25
28
27
42a
48
47
36
38
42
41
40
46
45
39
38
29
43
32
44
30
31
15
35
-21-
5
28
25
26
27
54
-18-
16
19
22
3
2
FIG. 4A

DRAWING, STRAIGHTENING, SECTIONING AND POLISHING MACHINE

The present invention relates to continuous bar-drawing benches and machines and more particularly to a continuous drawing machine generally employed in industry for the first transformation of steels and non-ferrous metals.

Continuous drawing machines are known which comprise two drawing carriages located immediately following on the calibrating die. These carriages are provided with jaws and relay each other to ensure the continuous drawing, one thereof effecting its inoperative return travel while the other advances the bar at a uniform speed.

The drawing machines of the aforementioned type have a large number of drawbacks, among which may be mentioned the slowness resulting from the necessity to pull the bar with one carriage while the other effects its inoperative travel which usually results in a jerky operation of the machine.

The speed of the inoperative return of the carriage is limited, which also limits the speed at which the bar is driven by the carriage engaged with the latter.

The drawing machines of the type having two carriages are of relatively complex construction in as much as they require a double equipment to perform the same function in turn.

These machines also have a large overall size. They are heavy, expensive to make and maintain, and noisy.

Depending on the diameter of the bars to be obtained, a plurality of sets of drawing jaws must be available.

The engagement of the drawing jaws on the bars may leave marks which may adversely affect the state of the surface of the bars obtained.

As the straightening of the bars is effected after cutting off, the ends of the bars undergo an imperfect straightening so that the product obtained cannot meet the requirements of narrow tolerances.

Carriage-type machines do not include polishers, since after cutting to length or sectioning, the polishing of each section is difficult to achieve.

An object of the invention is to overcome the aforementioned drawbacks and to provide a drawing machine which, while it is of a relatively simple and cheap construction relative to known drawing machines, it has a higher performance than the conventional machines.

According to the invention, there is provided a continuous drawing machine comprising a die and a pulling device for passing the product to be drawn through the die, wherein the pulling device comprises a drum rotatably mounted on a shaft journalled in a chassis, means for driving the drum in rotation and means for putting the drawn product under tension at the outlet of the drum so as to cause the drum to perform the function of a capstan for the product to be drawn.

Further features and advantages of the invention will be apparent from the ensuing description.

In the accompanying drawings given solely by way of example:

Figure 1:
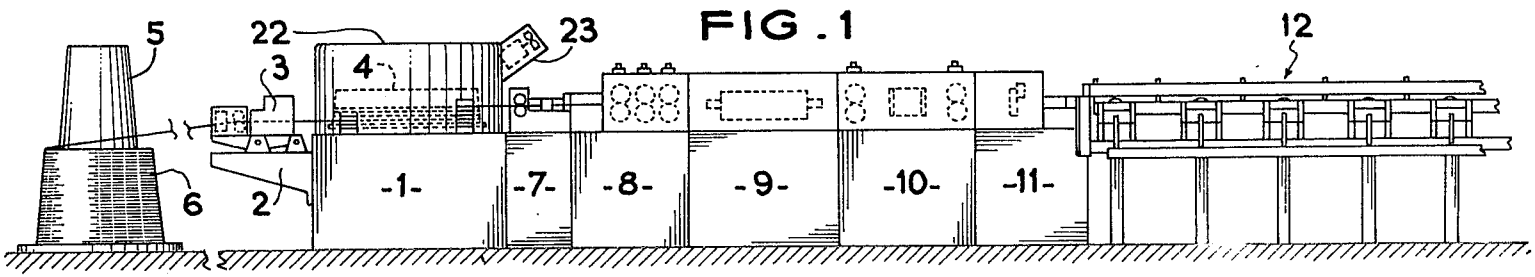
FIG. 1 is a general elevational view of a machine for drawing, straightening, sectioning and polishing according to the invention.
Figure 6:
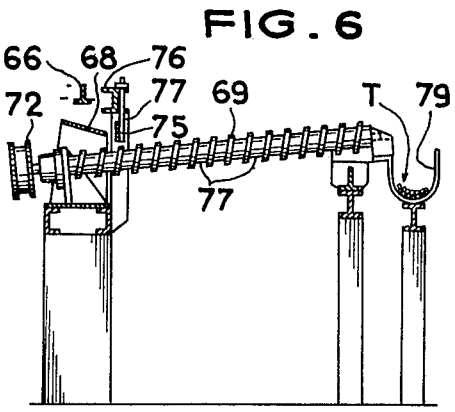
Figure 3B:
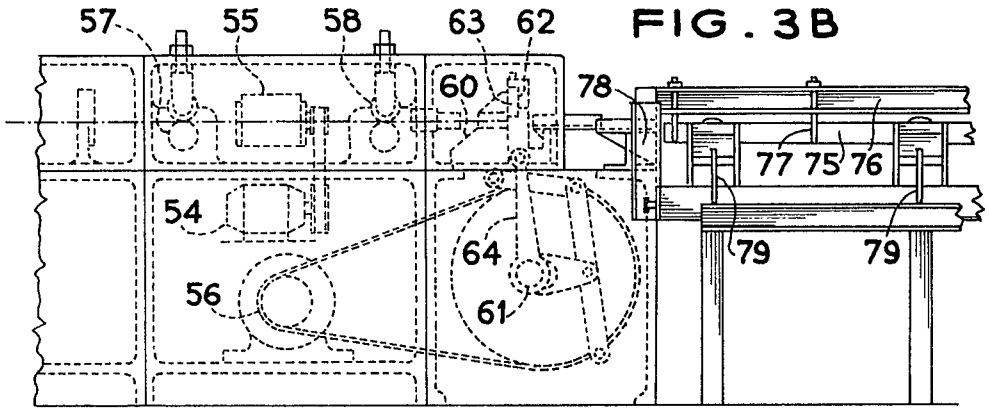
Figure 4B:
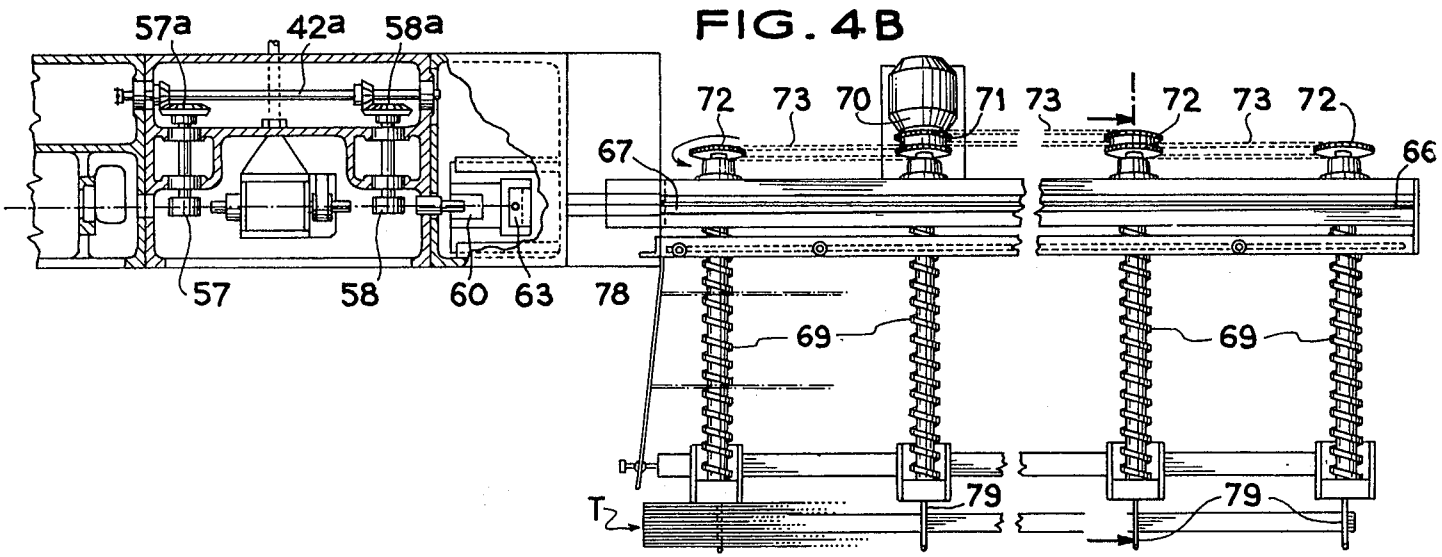

FIGS. 3A and 3B constitute together an elevational view, with a part in section, of the machine shown in FIG. 1, showing the details of the construction of some elements which are part of the structure of the machine;

FIGS. 4A and 4B constitute together a plan view, with parts cut away and parts in section, of the machine shown in FIGS. 3A and 3B;

FIG. 5 is a sectional view taken along line 5—5 of FIG. 4A;

FIG. 6 is a sectional view taken along line 6—6 of FIG. 4B, and

Figure 7:
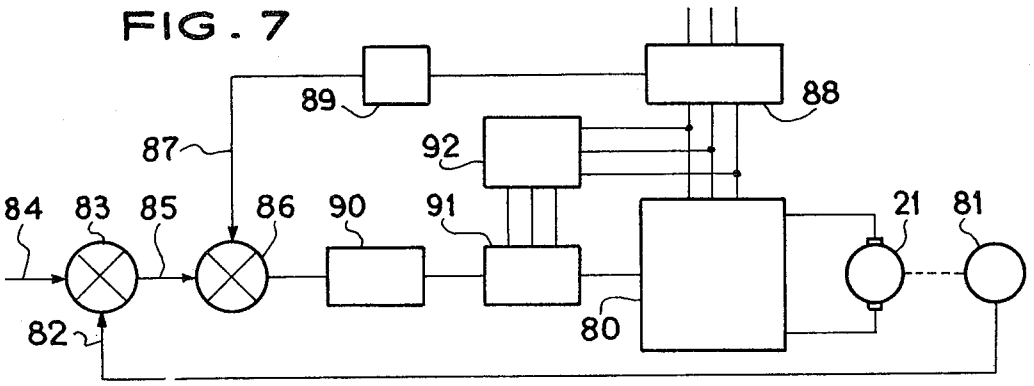

FIG. 7 is a synoptic diagram of a circuit controlling the drive motor of the drawing drum.

The machine shown in FIG. 1 comprises mainly a drawing bench 1 which includes a die-support 2 on which there is mounted a calibrating die 3 of conventional type.

The drawing-bench 1 comprises a drum 4 which is driven in rotation by means which will be described hereinafter.

Upstream of the die 3, relative to the travel of the product through the machine, there is disposed a reel 5 on which a roll 6 of material to be drawn is disposed.

Downstream of the drawing bench, there is disposed a pre-straightener 7 to which there is added a roller-type straightener 8. Downstream of the latter there is disposed a frame-type straightener 9 followed by a polisher 10, a shears 11 and a discharge and storage device 12.

In the embodiment shown in FIG. 1, the machine is intended to treat round bars, but it will be clear that this machine may also be employed for drawing bars of various sections, in which case the frame-type straightening unit 9 must be replaced by a roller-type straightening unit complementary to the unit 8.

It will be observed that the various units of the machine shown in FIG. 1 are modular, so that it is possible either to replace some units by identical units for repairs or to substitute some units to permit the machine to treat products of different nature, or to add new units to increase the capacity of the machine.

The machine is shown in more detail in FIGS. 3A and 3B to which reference will now be made.

The pulling unit 1 proper comprises a frame 15 on which the drum 4 is rotatably mounted.

This drum has a frustoconical lateral part the taper of which allows the coils formed to slide upwardly under the effect of the following coils in process of formation.

The drum 4 is keyed on a vertical shaft 16 which is rotatably mounted in a pit 17 formed in the frame 15. At the end thereof opposed to the drum 4, the shaft 16 carries a gear wheel 18 which meshes with a worm 19 which is journalled in bearings 20 provided in the frame 15 and is driven by a DC electric motor 21. The gear wheel 18 and the worm constitute a speed reducer.

The drum 4 is protected by a hood 22 which carries a fan 23 for cooling the drum in the course of the drawing operation.

The frame 15 carries, on the side thereof opposed to the die 3, a support 24 on which there is slidably mounted, radially of the drum 4, a rod 25 which carries, at the end thereof near to the drum, pressing rollers 26 which are pivotably mounted on the rod by a double fork 27. The rod is driven in translation by a double-acting jack 28.

The pressing rollers 26 are adapted to ensure that the coils of the drawn product are held stationary on the drum 4 when the product end seizing device is withdrawn for the purpose of passing the product end in the straightener, whose essential function in the machine according to the invention is to exert permanently on the drawn product a sufficient tensile force to permit the drum 4 to act as a capstan and thereby produce an appropriate drawing force in the region of the die 3.

Figure 2:
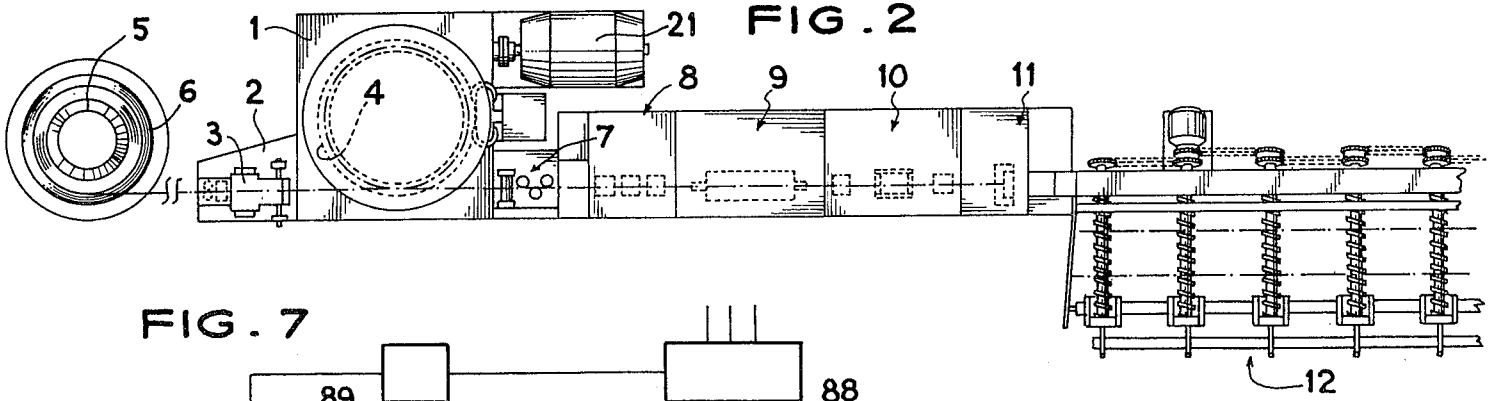
FIG. 2 is a plan view of the machine shown in FIG. 1.

The straightener assembly comprises, as shown in FIGS. 1 and 2, a pre-straightener 7, a roller-type pulling cage 8 and a frame-type straightener 9.

The pre-straightener 7 comprises a chassis 29 whose dimensions are adapted to those of the frame of the drawing bench, as are, moreover, the chassis of the other apparatus forming part of the construction of the machine, so that it is possible to rapidly replace one apparatus by another or to add one apparatus to the already existing assembly in any part of the machine, between two of the apparatus by which it is constituted.

Mounted on the chassis 29 are rollers 30, 31, 32 having vertical axes and grooves which define a passage for the drawn product.

The roller 31 is driven in rotation by a motor 33 through a free-wheel 34.

Disposed in front of the rollers 30 to 32 is a pair of rollers 35 having horizontal axes.

The roller cage 8, which is adapted to exert a tension on the drawn product in order to ensure that the capstan 4 operates well, comprises a chassis 36 on which there are rotatably mounted upper rollers 37 and lower rollers 38 having horizontal axes which define a working zone which pulls on the product.

Among the lower rollers 38, two are driving rollers. They are mounted on the end of shafts 39 which carry at their opposite ends bevel gear pinions 40 meshed with bevel gear pinions 41 keyed on a shaft 42.

The latter is driven in rotation by a D-C electric motor 43 whose output shaft carries a pulley 44 which is connected to a pulley 45 by a belt 46, the pulley 45 being carried by the shaft 42.

The rotatable frame straightener 9 comprises a chassis 47 in the upper part of which there is mounted a rotatable frame 48 having straightening bushings which are axially and radially adjustable in position (not shown).

The frame 48 is driven in rotation by a D-C motor 49 whose output shaft carries a pulley 50 which is connected to a pulley 51 (carried by the shaft of the frame 48) through a belt 52.

The polisher 10, following on the straightener 9, is for example of the type described in U.S. Pat. No. 4,045,937 issued to Christian M. Mandras, assignor to the present assignee. This polisher, whose operation is based on the centrifugal force imparted to weights to apply the rotating polishing-bushings on the surface of the product to be polished, will not be described in detail.

However, it will be mentioned that there is mounted in the chassis 53 of the polisher a motor 54 for driving the polishing head 55 and a motor 56 for driving the shears 11 following on the polisher.

In the illustrated embodiment, the polisher further comprises, on each side of the polishing head 55, rollers 57 and 58 for driving the product. The rollers 57 and 58 are driven in rotation by the motor 43 of the roller cage 8. The movement of rotation is transmitted by an extension 42*a* of the shaft 42, which extends through the frame straightener 9, and by bevel gear systems 57*a*, 58*a* (FIG. 4B).

The shears 11 is a mobile shears on the chassis 59 of which there is mounted a carriage 60 to which there is imparted a movement reciprocated in the direction of the drawn product by a crank-shaft 61 which also drives a sectioning slide 62 mounted on the carriage 60.

The slide 62 carries a blade 63 which co-operates with a counter-blade (not shown) mounted on the carriage.

An inertia flywheel is keyed on the crank-shaft 61.

The shears is operated by electronic means.

Following on the shears 11, relative to the direction of travel of the product, there is provided a discharging and storage device 12 for the drawn product sectioned to the required length.

This device comprises mainly a chassis 65 which carries, in alignment with the output of shears 11, a guide 66 for the drawn bar.

This guide is constituted by an inverted T-section member of which one of the flanges, 67, is pointed so as to present a practically zero width in the region of the output of the shears and a maximum width at its opposed end and thereby facilitate the fall of the section, after the sectioning thereof to the required length by the shears.

Under the guide 66, the chassis 65 carries an elongated plate 68 forming an inclined plane for the sectioned bar sections and extending to above the ends of a series of screws 69, for example of plastics material, evenly spaced apart, parallel to each other and driven in rotation by an electric motor 70 whose output shaft is directly coupled to one of the screws 69 and carries a gear pinion 71 through which the motor 70 drives the other screws through gears 72 keyed on the screws and chains 73.

Facing the lower edge of the inclined plate 68, there is disposed a vertical plate 75 carried by a rail 76 and fixed to the latter by screw-threaded rods 77.

The plate 75 performs the function of a stop adapted to prevent the sectioned bar sections from falling too far away on the screws 69 under the effect of their momentum.

The screws 69 have a pitch defining a series of gaps 77 adapted to receive bar sections sectioned by the shears.

At the end of the discharging device in the neighbourhood of the shears, the chassis 65 carries a shield 78 which co-operates with the screws 69 so as to produce, at the output end of the screws, the alignment of the bar sections.

The discharging device comprises a storage trough 79 for storing the sections T obtained, in which the sections fall from the screws with the same longitudinal position determined by the shield 78 in combination with the screws 69.

The pulling capstan 4, the straightening frame 48, the driving rollers 38 of the roller cage 8 and the driving rollers 57, 58 of the polisher 10 and the shears 11 are driven by individual D-C motors 21, 43, 49 and 56.

These motors must have the same speed increasing slope.

The motor 21 of the pulling unit is controlled by the circuit of FIG. 7 which will now be described. The motor 21 is supplied with current by the three-phase mains through a converter 80. A tachometric dynamo 81 is keyed on the output shaft of the motor 21 and connected to an input of a comparator 83 whose other input 84 receives a reference signal corresponding to a required or set speed.

The output of the comparator 81 is connected to an input of another comparator 86 whose other input 87 is connected to a circuit for measuring the current intensity 88 connected to the three-phase mains supply through a current intensity limiting circuit 89.

The output of the comparator 86 is connected to a deviation amplifier 90 which controls an initiating circuit 91 of the converter 80, the circuit 91 being connected to the three-phase mains supply through a synchronization circuit 92.

The motor 43 actuating the rollers 38, 57 and 58 is controlled as a function of the torque required for applying a suitable pull on the product on the output side of the capstan. It permits in this way ensuring the straightening speed relative to the drawing speed irrespective of the diameter of the drawn product.

The clutch of the shears 11 is engaged by electronic means as a function of the travel of the drawn product, of the length of the product to be sectioned and of the variations of the stop position of the shears due to the dispersion of the braking device of the shears.

The machine just described operates in the following manner:

After the product end has been fixed issuing from the die 3 in a product end seizing device, the motor 21 driving the drum 4 is started up.

The rotation of the motor 21 is transmitted to the drum 4 through the screw 19 and the gear wheel 18 so that the coils of the drawn product start to wind onto the drum, which is continuously cooled by the fan 23. When a sufficient number of coils has been wound onto the drum to ensure a good friction, the motor 21 is stopped and the jack 28 is supplied so as to apply the rollers 26 against the drum. The product end is then disengaged from the product end seizing device and the rollers 26 ensure that this release does not produce an expansion or loosening of the coils of product wound on the drum owing to the elasticity of the drawn product.

The product end is thereafter introduced in the prestraightener 7 whose motor 33, in driving the roller 31, ensures the introduction of the product end in the roller cage 8 whose rollers 37, 38 are driving rollers and exert a tension on the product wound on the drum 4. Then the motor 33 is stopped and the roller 31 rotates as a free wheel. The jack 28 is then actuated in the opposite direction and this withdraws the support rollers 26. As the product is put under tension, the motor 21 driving the drum 4 is again started up and the drawing operation proper commences.

The circuit shown in FIG. 7 regulates the motor 21 in the following manner:

The required speed is fed into the system by a potentiometer (not shown) which regulates the voltage applied to the input 84 of the comparator 83. The output voltage of the tachometric generator 81 is permanently compared with this value. The error voltage is applied to the input of the amplifier 90 whose output signal is applied to the circuit 91 initiating the converter 80. the current measuring circuit 88, constituted by current transformers, permits a galvanic isolation of the control circuits relative to the power circuits. The output voltage of the circuit 88 is applied to the current intensity limiting circuit 89 adapted to limit, during starting up and transitory speeds, the peak values of current intensity to acceptable values.

The operation of the roller-type straightener 7, the frame-type straightener 9 and the polisher 10 is known and will not be described in detail.

However, it will be mentioned that the pulling rollers 38 of the cage 8, and 57 and 58 of the polisher 10 are all driven in synchronism by the same motor 43 through the shaft **42, 42*a* and the corresponding bevel gears and that their rotation is governed by the tension to be exerted on the product at the output of the drum 4**.

As concerns the operation of the shears, it is controlled, as mentioned hereinbefore, by electronic means as a function of the speed at which the drawn product travels, of the length of the sections to be sectioned and of the stop position of the shears in the course of the preceding sectioning. This permits obtaining high precision on the length cut.

Before a cutting or sectioning operation takes place, the bar travels on the discharging and storage device 12 onto which it is directed by the guide 66 (FIG. 4B).

The bar is supported by the flange 67 of the guide which is pointed so that, when the sectioning takes place, as the section is no longer supported by its rear end, it falls onto the inclined plate 68 and is directed by the latter and by the vertical plate 75 to the screws 69.

The screws 69 cause the section to move towards the trough 79, but also displace it longitudinally so that it abuts against the shield 78 so that, at the end of the travel, all the sections fall into the trough 79 with identical axial positions which considerably facilitates the formation of batches.

In the embodiment just described, the machine is adapted to draw round bars, but it is of course possible to employ this machine for drawing sections of other shapes.

It is merely sufficient for this purpose to replace the die and the frame straightener 9 by a roller straightener complementary to the straightener 8 and eliminate the polisher 10. These operations are rendered possible owing to the modular form of the various elements of the machine.

In the presently-described embodiment, the pulling rollers 38, 57, 58 are driven by a single D-C motor, but it is possible to envisage the driving of each pair of rollers by independent motors all of which are controlled by the pull required to be exerted on the drawn product at the output of the drum 4.

The machine according to the invention has a number of advantages over conventional drawing machines.

It is more rapid, smaller and less noisy than machines having reciprocating carriages.

It does not mark the product in the course of the stages following on the drawing and this avoids rejects.

Owing to the fact that the product is drawn continuously, it is possible to employ for round bars a straightener having a rotating frame and a polisher.

It permits obtaining a sectioning to a required length of high precision, which avoids the necessity for any subsequent operation for cutting to length.

It is relatively simple in construction.

It is constituted by modular elements which permits adapting the machine to the particular needs of the manufacturer of the drawn products.

Having now described our invention what we claim as new and desire to secure by Letters Patent is:

1. A machine for continuously drawing a product comprising a draw die, a pulling device for drawing the product to be drawn through the die, the pulling device comprising a chassis, a shaft journalled in the chassis, a drum mounted on the shaft and for receiving the drawn product wound thereon, means for driving the drum in rotation, the drum having an input side for receiving the drawn product from the die and an output side from which the drawn product extends, and means for putting the drawn product extending from the output side of the drum under tension so as to cause the drum to perform the drawing action of said product through said draw die, said means for driving the drum in rotation comprising a D-C motor and a circuit for varying the current supplied to said motor as a function of the amount of tension that must be exerted on the product at the output side of the drum so that the latter performs the drawing action of said product, wherein the means for putting the product under tension at the output of the drum comprise a roller cage disposed in the path of the drawn product, driving rollers of the roller cage being rotated by a further D-C motor controlled in accordance with the force to be exerted on the drawn product at the output side of the drum.

2. A machine as claimed in claim 1 for drawing round bars, and further comprising a polisher for the drawn product, the polisher comprising a polishing head and rollers for driving the drawn product and synchronized with the rollers of the roller cage, said rollers constituting also means for tensioning the drawn product.

3. A machine as claimed in claim 1, wherein the driving rollers of said roller cage and the rollers of said polisher are driven by the same electric motor through a mechanical transmission.

4. A machine as claimed in claim 1, wherein the driving rollers of said roller cage and the rollers of said polisher are driven by separate electric motors, namely one pair of rollers per motor, means being provided for synchronizing said roller driving motors.

5. A machine as claimed in claim 2, comprising between said roller straightener and the polisher a frame straightener and a D-C motor for driving the frame straightener.

6. A machine according to claim 1, wherein said circuit for varying the current supplied to said motor as a function of the amount of tension that must be exerted on the product at the output side of the drum comprises a tachogenerator mechanically connected to said motor and having an output connected to one input of a first comparator, said comparator having a second input receiving a reference signal corresponding to a set speed of said motor, and an output connected to a first input of a second comparator which has a second input connected to a circuit for measuring the intensity of the current supplied to said motor and an output connected to a control input of a circuit for controlling the supply current of said motor.

7. A machine according to claim 6, wherein said circuit for controlling the supply current of said motor is an A.C-D.C converter for converting a three-phase mains current into a D-C current, said circuit further comprising a deviation amplifier inserted between said second comparator and said converter, and a synchronization circuit connecting said amplifier to said three-phase mains.

* * * * *